United States Patent [19]

Shannon et al.

[11] Patent Number: 4,649,856

[45] Date of Patent: Mar. 17, 1987

[54] PRODUCTION OF INSULATED ELECTRICAL CONDUCTORS

[75] Inventors: Michael A. Shannon, Glenburnie; Steven D. Manders, Harrowsmith, both of Canada

[73] Assignee: Northern Telecom Limited, Montreal, Canada

[21] Appl. No.: 817,955

[22] Filed: Jan. 13, 1986

Related U.S. Application Data

[62] Division of Ser. No. 597,648, Apr. 6, 1984, Pat. No. 4,587,133.

[51] Int. Cl.[4] ..... B05C 11/00

[52] U.S. Cl. ..... 118/712; 118/405; 118/420; 427/10; 427/163; 427/434.7

[58] Field of Search ..... 427/10, 163, 437.7; 118/712, 405, 420

[56] References Cited

U.S. PATENT DOCUMENTS 4,246,299 1/1981 Ohls ..... 427/54.1
4,370,355 1/1983 Niesse ..... 427/10
4,439,467 3/1984 Kassahun ..... 427/163
4,480,898 11/1984 Taylor ..... 427/163
4,533,570 8/1985 Iyengar ..... 427/163

*Primary Examiner*—Richard Bueker
*Attorney, Agent, or Firm*—R. J. Austin

[57] ABSTRACT

In providing a dried insulation layer upon conductor, a covering fluid layer is initially provided by apparatus in which the layer is formed from composite material comprising magnetically permeable particles homogeneously mixed with a fluid carrier. The fluid layer is formed by passing the conductor through a reservoir of the material and then vertically through a die orifice. The reservoir of fluid applies pressure at the die orifice and this pressure is adjustable to vary the rate at which the material passes through the orifice and thus varies the diameter. This pressure is controllable by adjusting the height of the reservoir above a die orifice or by adjusting gas pressure acting downwardly upon the material. The diameter of the layer is advantageously monitored after it is dried and variation in monitored diameter from that desired effects a change in pressure to alter the diameter towards that desired. The diameter of the layer may, however, be monitored with the layer in fluid form.

4 Claims, 3 Drawing Figures

PRODUCTION OF INSULATED ELECTRICAL CONDUCTORS

Figures 1, 2:
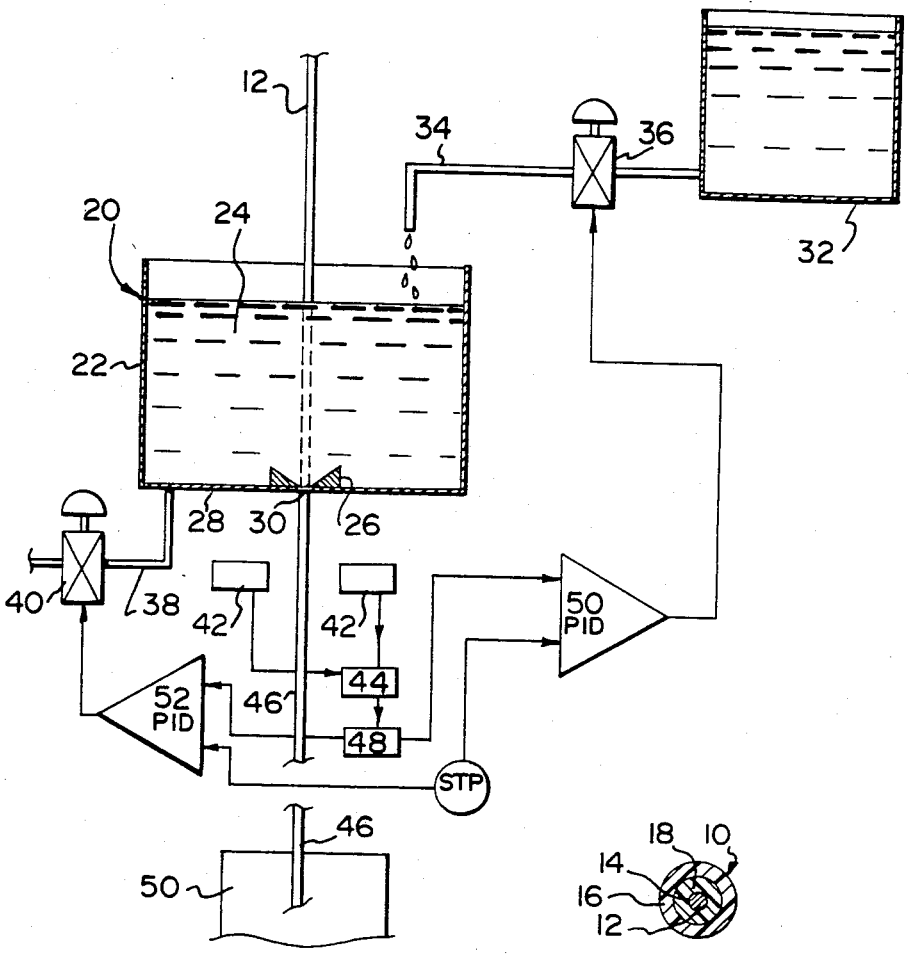

This invention relates to the production of insulated electrical conductors and is particularly concerned with apparatus for forming insulated telecommunications conductors and is a divisional application of application Ser. No. 597,648, filed Apr. 6, 1984 now U.S. Pat. No. 4,587,133, in the names of M.A. Shannon and S.D. Manders and entitled PRODUCTION OF INSULATED ELECTRICAL CONDUCTORS.

Telecommunications cable comprises a core of insulated electrical conductors arranged in twisted pairs. Discrete loading is applied at spaced intervals to voice transmission cable to increase the inductance and decrease the attenuation of a pair of conductors over a band off requencies. Loading is provided to decrease attenuation in the voice frequency range, i.e. up to about 5 kHz and is also useful to decrease attenuation in the lower carrier frequency ranges.

An alternative loading which has been suggested is in the form of a continuous layer surrounding each conductor. This layer, which will be referred to in this specification as "continuous loaded layer", is composed of particles of magnetically permeable material dispersed in a dielectric material, the particles separated from each other to render the layer substantially non-conductive. Surrounding this layer is another layer formed from dielectric material and devoid of magnetically permeable particles. This form of insulated conductor has been described in U.S. Pat. No. 4,079,192, in the name of B. Josse, dated Mar. 14, 1978 and entitled "Conductor For Reducing Leakage at High Frequencies", and also in British Pat. No. 313,895 and German Offenlegungsschrifts NO. 2,050,913 and 2,461,611.

Problems are associated with the manufacture of conductor having a continuous loaded layer. At least some of these problems relate to the fact that the layer is applied as a mixture of fluid dielectric carrier material and particles. To maintain homogeneity of the mix, the carrier material is of essentially lower viscosity than dielectric material for conventional insulated layers. MDre viscous materials result in resistance to dispersion of the particles during mixing. As the composite material has a lower viscosity, it has been found that it cannot be applied by conventional extrusion methods for the forming of dielectric layers upon electrical conductors as the low viscous material flows around its conductor under gravity. Thus in the completed layer after hardening, eccentricity of the layer is found to have occurred. This eccentricity leads to non-uniformity in electrical characteristics of the insulated conductor and uncontrollable variations in mutual capacitance between the conductors in the completed cable.

Further problems occur during the application of the composite material as a covering layer upon the conductor as a first stage in forming the continuous loaded layer. The magnetically permeable particles tend to be abrasive because they are formed from naterials such as ferrite. If a die is used for extruding the composite material as the covering layer onto the conductor, then the abrasive particles passing through the die gradually wear away the material forming the orifice so that the orifice becomes enlarged. Hence, there is a tendency for the continuous loaded layer to become gradually larger in diameter during commercial production. This presents practical problems in that the thickness of the layer will affect the electrical characteristics and performance of the conductor along the length of the cable.

The present invention provides apparatus for forming a covering layer of the composite material upon a conductor which has a substantially constant diameter along the conductor length so as to produce a continuous loaded layer which is also of constant diameter.

The invention provides an apparatus for forming a covering layer of substantially constant diameter upon an electrical conductor, the layer formed from composite material comprising magnetically permeable particles homogeneously mixed with a fluid carrier, the apparatus comprising a container for holding a reservoir of the fluid composite material, a die means providing an outlet from the container to form the fluid covering layer upon the conductor moving out from the container in a vertical direction along a feedpath, monitoring means for monitoring the diameter of the covering layer downstream from the die means, means to ensure the reservoir of material applies a pressure at the die orifice, and control means operable upon the monitoring means monitoring a diameter which is at variance with that desired, to adjust the pressure of the material at the die orifice thereby to alter the rate of passage of the material through the orifice and change the diameter towards that desired.

Figure 3:
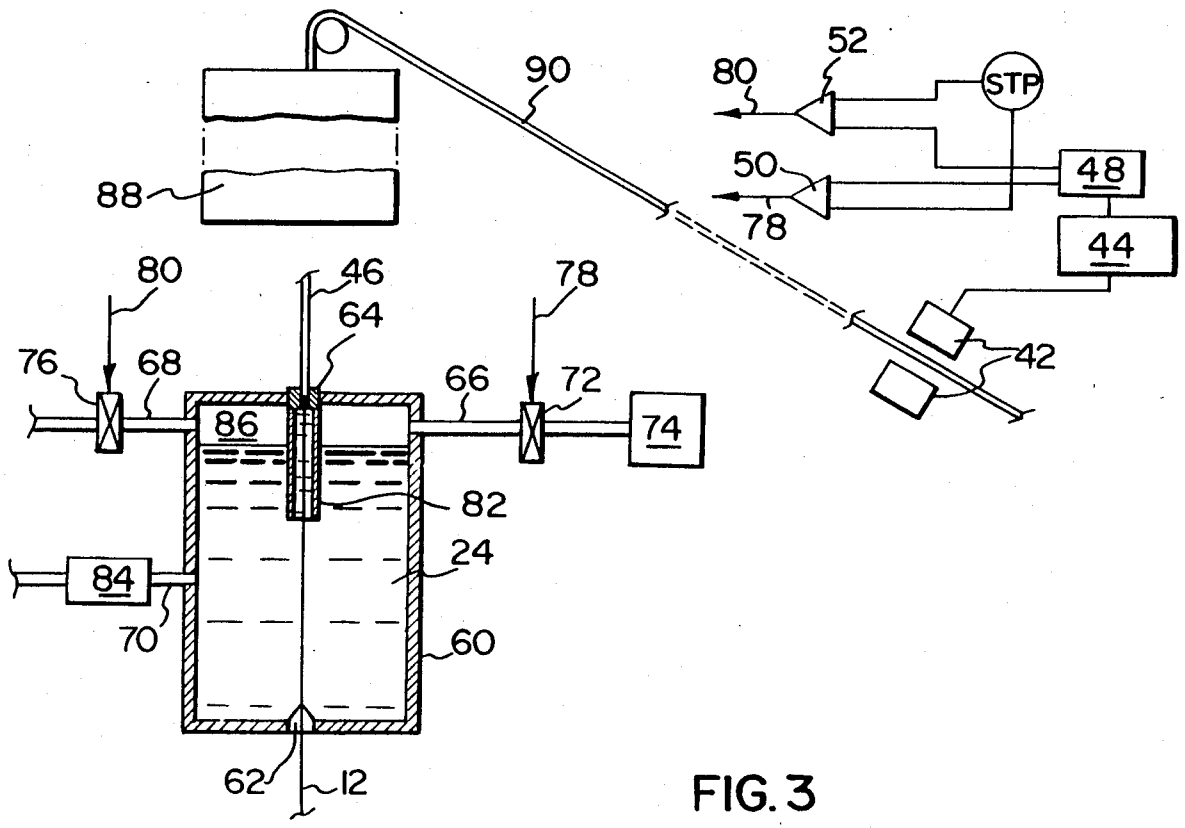

Embodiments of the invention will now be described by way of example with reference to the accompanying drawings in which:

FIG. 1 is a cross-sectional view through a telecommunications conductor;

FIG. 2 relates to a first embodiment and is a diagrammatic side elevational view, partly in cross-section, of an apparatus for providing a covering fluid layer to form an inner insulating layer upon the conductor shown in FIG. 1; and FIG. 3 is a view similar to FIG. 2 of a second embodiment.

As shown in FIG. 1, an insulated telecommunications conductor 10 comprises a conductor 12 surrounded by two insulating layers 14 and 16. The outer layer 16 is a conventional insulating layer in that it is formed from a single material, e.g. polyethylene. The inner layer 14 is a composite layer of a carrier material homogeneously mixed with magnetically permeable particles which in this case are ferrite particles. The carrier may be of any suitable insulating material which may be mixed homogeneously with the ferrite particles and which may be applied by commercial techniques. In this case, the carrier material is formed from a cross-linkable emulsion having 45% solids content, the emulsion having been dried to cross-link it after application. One suitable emulsion is an acrylic emulsion made by Rhoplex sold under their trade No. NE1612.

Apparatus according to a first embodiment for providing the layer 14 upon the conductor is shown in FIG. 2. The apparatus 20 comprises a container 22 which holds a reservoir of the composite homogeneous material 24 in a fluid condition. The viscosity of the composite material is extremely low compared to the viscosities of conventional insulating materials which are fed onto a conductor by extrusion techniques. In this particular case, the composite material has a viscosity of up to 5,000 centipoise. At the bottom of the container is provided a die 26 which is secured to a base 28 of the container and has a die orifice 30 which is of a diameter for providing the required thickness of the composite covering fluid layer upon the conductor and which, in its dried form, will provide the layer 14 in its desired thickness. The die may have a diamond die insert (not shown) or have a ceramic material for forming the die orifice. This ceramic material may be that sold under the trade name "Henium", as sold by the Heny Die Corporation. A main storage reservoir 32 is provided for adding the composite material 24 to the container 22 through an inlet pipe 34 and the flow rate is adjustable through a supply valve 36. For removing composite material from the container 22, an outlet pipe 38 is provided together with an outlet valve 40 for controlling the rate of dispensing the material 24. The valve means 36 and 40 form part of a means to ensure the reservoir applies pressure at the die orifice and to control the height of the material.

Means is provided for monitoring the diameter of a covering fluid layer of composite material provided upon the conductor by passage through the orifice 30. This means comprises a laser micrometer 42 which is of conventional construction for measuring thicknesses of materials.

Control means is provided and is operable, upon the monitoring means monitoring the diameter of a covering fluid layer of composite material which is at variance with that desired upon the conductor, to control the degree of opening of the valves 36 and 40. As shown by FIG. 2, the control means to adjust the height of the quantity of fluid composite material comprises a microprocessor 44 which compares signals received from the laser micrometer 42 with a datum signal corresponding to the desired diameter of the layer 46 of composite material as it moves away from the die orifice 30. If there is a difference between the received and datum signals, then the microprocessor sends a signal to multiplexer switch 48. The multiplexer switch then sends signals appropriately to proportional derivative controllers 50 and 52 of the control means to alter the degree of opening of the valves 36 and 40.

During operation of the apparatus, the conductor 12 is fed vertically downwards through the fluid 24 and out through the orifice 30 carrying with it the layer 46 of the fluid composite material. The height of the surface of the composite material 24 in the container 22 above the aperture decides the pressure in the material at the bottom of the container and hence at the die orifice 30. This pressure is one of the parameters which decides the rate of flow of the composite material through the die orifice. Thus, if the height of the composite material is changed, the pressure around the die orifice also changes and the flow rate through the orifice and thus the thickness of the layer 46 is altered. In this embodiment, the height of the reservoir of material 24 is maintained by a flowthrough of the composite material in that the valves 36 and 40 are both open and the rate of flow through the inlet 34 balances the outlet flow through the outlet 38 together with the flow through the aperture 30. As the coated conductor passes downwardly from the container it moves vertically into a drying oven 51 in which the composite material is dried and cured to form the continuous layer 14 as shown in FIG. 1.

The outside diameter of the layer 46 issuing from the aperture 30 is continuously monitored by the laser micrometer which sends signals to the microprocessor 44 which compares these signals with the datum signal as discussed above. If, for any reason, the thickness of the layer 46 varies from that desired, then the signal produced by the micrometer differs from the datum signal at the microprocessor 44 and this results in a control signal being sent to the multiplexer switch 68 for control of the height of the reservoir of composite material 24 in the container. Dependent upon the value of the signal received by the multiplexer, an analog signal is sent to the appropriate proportional controller 50 or 52 which then issues a control signal for opening or closing a valve 36 or 40 as the case may be. Operation of either or both valves adjusts the flow rate into and out of the container 22 until the upper surface of the reservoir has been adjusted in level to provide the appropriate pressure around the die orifice and alter the thickness of the layer 46 to give the diameter which is desired. A possibility for the change in diameter occurs during use of the apparatus when large quantities of conductor have passed through the container. In this case, it may be found that even with a diamond or ceramic die orifice material, that wear occurs and enlargement of the orifice takes place. Fortunately, while this wear is such that a substantially circular orifice is maintained, the result is that with a constant height of the reservoir of composite material in the container 22, the enlarged die orifice must provide a larger diameter composite material layer 46. Such a condition would result in a slowly increasing diameter along a substantial length of conductor and this would have an undesirable effect upon the electrical characteristics of the final insulated conductor. To ensure that the diameter of the material laid onto the conductor is maintained substantially constant, then as wear does occur to the die, it will be necessary to reduce the height of the reservoir to lower the pressure of the fluid around the die orifice. Any increase in diameter which may be caused by wear upon the die orifice material is immediately monitored by the laser micrometer. A resultant signal sent by the appropriate controller 50 or 52 opens or closes the valves 36 or 40 in the desired manner to lower the level of the composite material 24 to lower the rate of flow of the material through the orifice and reduce the diameter to that required.

Hence, as shown by the above embodiment, while a composite loaded layer of material applied to a conductor may contain abrasive particles such as ferrite which affects widening of die openings during manufacture, it is possible for there to be control in the final thickness and diameter of the layer which is applied to the conductor.

In a modification of the operation of the apparatus described above, it may be found that the exhaust valve 40 may be maintained closed and the height of the material 24 can be held in the desired position merely by operation of the valve 36 by control signals fed to the proportional controller 50.

As indicated in the above embodiments, it is the height of the composite material 24 above the die orifice which dictates the pressure of the material at the orifice. Bearing this in mind, in a modification to the first embodiment (not shown), the die means 26 is mounted on a vertically movable means by which the distance between the die orifice and the level of the upper surface of the material can be changed. A flexible seal may be provided between the die means 26 and the base of the container to retain the composite material within the container apart from that which goes through the die orifice. In another modification of the first embodiment, in which it is possible for the conductor to be fed upwardly instead of downwardly through the container, the guide means is mounted on a vertically moveable structure which is disposed to be partly submerged within the composite material. A tubular extension from the die means extends upwardly out from the composite material to prevent the material from completely submerging the die means. Thus, if the die means with its structure is moved into and out of the composite material then its height varies with regard to the upper surface of the material thereby varying the pressure of the material against the die orifice at its under surface.

Apparatus according to a second embodiment is shown in FIG. 3, in which parts of the structure which operate in the manner described with reference to FIG. 1 are given the same reference numerals. As shown by FIG. 3, a container 60 receives the conductor 12 upwardly through the composite material 24 through a seal 62 in the base of the container. The container is a closed container except for the die orifice of die means 64, a pressurized gas inlet 66, a pressurized gas outlet 68 and an inlet 70 for the mixture 24.

The inlet and outlet 66 and 68 form part of a means for ensuring change in pressure of the material 24 at the die orifice. This pressure ensuring means also includes a valve 72 which connects and disconnects a gas pressure source 74 through the inlet 66 to the top of the chamber in the container 60, and an outlet valve 76 in the gas outlet 68. The controller 50 is responsible for controlling the opening of the inlet valve 72 by loop 78. Similarly, the controller 52 controls the opening of the valve 76 through loop 80.

To apply the pressure of the material 24 upwards against the die orifice, an annular baffle in the form of a cylindrical sleeve 82 extends downwardly from the die means 64 and beneath the upper surface of the material 24 so as to horizontally separate composite material within the baffle from that outside of it.

In use of the apparatus of the second embodiment, the mixture 24 is supplied from a source (not shown) by a pump 84 through the inlet 70. The pump is a low shear pump and is necessary for forcing the material into the container 60 against the gas pressure within a chamber 80 in the container, the gas pressure operating downwardly upon the material. The gas pressure supplied from the source 74 causes a pressurized column of the composite material to project upwardly within the baffle so as to contact the die orifice and pressurize it. This situation is shown in FIG. 3. Hence, the pressure of the material at the die orifice is changeable by changing the pressure of the gas within the chamber 86. The conductor 46 bearing the fluid coating layer passes upwardly from the container and through a drying oven 88 and a conductor 90 emerges carrying the dried covering layer, i.e. the continuous loaded layer. The conductor 90 carrying the dried covering layer then passes through the laser micrometer 42 which operates in a manner similar to that described in the first embodiment to produce a signal which is compared with a datum signal in the microprocessor 44, also as described in the first embodiment. The multiplexer switch and the controllers 50 and 52 also operating in the manner described above provide signals as necessary along the loops 78 and 80 to control the degree of opening of the valves 72 and 76, so as to vary the gas pressure within the chamber 86. This causes variation in the pressure of the material 24 at the die orifice and affects the rate at which the material passes through the orifice to form the fluid layer upon the conductor at 46. Hence, the adjustable gas pressure within the container 60 effectively changes the diameter of the dried continuous loaded layer towards that desired and is dependent upon monitoring signals sent from the laser micrometer 42.

Hence, as can be seen, gas pressure is used in the second embodiment to vary the pressure of the composite material at the die orifice instead of controlling this by the level of the upper surface of the material as in the first embodiment.

It is preferred as described in the second embodiment for the monitoring of diameter to be taken upon the dried continuous loaded layer because this is the finished diameter of the product. However, monitoring may be taken in a modification of the second embodiment between the container 60 and the oven 88 in a manner similar to that described in the first embodiment. In addition, in a further modification of the first embodiment, the laser micrometer may be disposed downstream of the oven in a manner similar to that described in the second embodiment.

We claim:

1. Apparatus for forming a covering layer of substantially constant diameter upon an electrical conductor, the layer formed from composite material comprising magnetically permeable particles homogeneously mixed with a fluid carrier, the apparatus comprising: a container for holding a reservoir of the fluid composite material; a die means at the top of the container having a die orifice providing an outlet from the container to provide a fluid phase of the covering layer upon the conductor moving out of the container in a vertical direction along a feedpath; an annular baffle extending downwardly from the die means to horizontally separate composite material with the baffle from that outside the baffle; monitoring means for monitoring the diameter of the covering layer downstream from the die means; means to apply gas pressure upon the composite material outside the baffle to create a pressurized column of composite material within the baffle extending upwardly to apply pressure at the die orifice; valve means to control and adjust the gas pressure and thereby control and adjust the pressure of the composite material at the die orifice; and control means, operable upon the monitoring means monitoring a diameter which is at variance from that desired to operate said valve means to adjust the gas pressure appropriately to alter the rate of passage of the material through the orifice and effect a change in diameter towards that desired.

2. Apparatus for forming a covering layer of substantially constant diameter upon an electrical conductor, the layer formed from composite material comprising magnetically permeable particles homogeneously mixed with a fluid carrier, the apparatus comprising: a container for holding a reservoir of the fluid composite material; a die means at the top of the container having a die orifice providing an outlet from the container to provide a fluid phase of the covering layer upon the conductor moving out of the container in a vertical direction along a feedpath; an annular baffle extending downwardly from the die means to horizontally separate composite material within the baffle from that outside the baffle; monitoring means for monitoring the diameter of the covering layer downstream from the die means and for transmitting a signal corresonding to a monitored diameter; means to apply gas pressure upon the composite material to ensure the material applies a pressure at the die orifice; valve means to control and adjust the gas pressure and thereby control and adjust the pressure of the composite material at the die orifice; and control means comprising analyzing means for receiving the signal from the monitoring means and for comparing it with a datum signal corresponding to a desired diameter of covering layer upon the conductor, the control means operable to transmit a control signal to the valve means when the monitored diameter differs from that desired to effect operation of the valve means to adjust the gas pressure appropriately to alter the rate of passage of the material through the orifice and effect a change in diameter towards that desired.

3. Apparatus according to either of claims 1 and 2 wherein the monitoring means is disposed to monitor the diameter of the covering layer when this is in fluid form.

4. Apparatus according to either of claims 1 and 2 provided with a means to dry the covering layer and the monitoring means is disposed downstream along the feedpath from the drying means so as to monitor the diameter of the dried covering layer.

* * * * *